United States Patent [19]

Roucaute

[11] Patent Number: 4,879,807

[45] Date of Patent: Nov. 14, 1989

[54] METHOD OF MAKING A SEALED COAXIAL CABLE SPLICE

[75] Inventor: Philippe Roucaute, Chambly, France

[73] Assignee: Raychem Pontoise S.A., France

[21] Appl. No.: 201,704

[22] Filed: Jun. 2, 1988

[30] Foreign Application Priority Data

Jun. 8, 1987 [GB] United Kingdom ..... 8713369

[51] Int. Cl.[4] ..... H01B 13/20

[52] U.S. Cl. ..... 29/828; 174/88 C

[58] Field of Search ..... 29/828; 174/88 C

[56] References Cited

U.S. PATENT DOCUMENTS

| | | | |
|---|---|---|---|
| 2,937,228 | 5/1960 | Robinson | 174/88 C |
| 3,297,819 | 1/1967 | Wetmore | 174/88 C |
| 4,144,404 | 3/1979 | DeGroef et al. | 29/828 |
| 4,383,131 | 5/1983 | Clabburn | 174/88 C |

FOREIGN PATENT DOCUMENTS

| | | |
|---|---|---|
| 0133371 | 2/1985 | European Pat. Off. . |
| 7119226 | 5/1971 | Fed. Rep. of Germany . |

*Primary Examiner*—Timothy V. Eley

*Assistant Examiner*—K. Jordan

*Attorney, Agent, or Firm*—Simon J. Belcher; Herbert G. Burkard

[57] ABSTRACT

A method of forming a sealed connection to a coaxial cable, preferably splicing two or more coaxial cables comprises:

(a) forming a connection between the central conductor e.g. a solder or crimp connection;

(b) positioning and recovering a heat shrinkable sleeve over the connection, the sleeve containing a shield portion for connecting the shield of the coaxial cables and being provided with quantities of sealing material which will extend beyond the ends of the sleeve after recovery; and (c) recovering a further heat shrinkable sleeve over the connection. Further sealing elements are provided with fuse with the sealing material associated with the other sleeve to form a barrier against ingress of moisture to the electrical connection.

The method is particularly suited to the formation of connections that will be subjected to large changes in ambient pressure as may be experienced in aircraft.

12 Claims, 1 Drawing Sheet

METHOD OF MAKING A SEALED COAXIAL CABLE SPLICE

BACKGROUND OF THE INVENTION

This invention relates to connections to coaxial cables and especially to splices between coaxial cables.

In particular the invention relates to the formation of sealed electrical connections by means of dimensionally heat-recoverable article.

Heat-recoverable articles are articles the dimensional configuration of which may be made substantially to change when subjected to heat treatment.

Usually these articles recover, on heating, towards an original shape from which they have previously been deformed but the term "heat-shrinkable", as used herein, also includes an article which, on heating, adopts a new configuration, even if it has not been previously deformed.

In their most common form, such articles comprise a heat-shrinkable sleeve made from a polymeric material exhibiting the property of elastic or plastic memory as described, for example, in U.S. Pat. Nos. 2,027,962; 3,086,242 and 3,597,372. As is made clear in, for example, U.S. Pat. No. 2,027,962, the original dimensionally heat-stable form may be a transient form in a continuous process in which, for example, an extruded tube is expanded, whilst hot, to a dimensionally heat-unstable form but, in other applications, a preformed dimensionally heat-stable article is deformed to a dimensionally heat-unstable form in a separate stage.

In the production of heat-recoverable articles, the polymeric material may be cross-linked at any stage in the production of the article that will enhance the desired dimensional recoverability. One manner of producing a heat-recoverable article comprises shaping the polymeric material into the desired heat-stable form, subsequently cross-linking the polymeric material, heating the article to a temperature above the crystalline melting point or, for amorphous materials the softening point, as the case may be, of the polymer, deforming the article and cooling the article whilst in the deformed state so that the deformed state of the article is retained. In use, since the deformed state of the article is heat-unstable, application of heat will cause the article to assume its original heat-stable shape.

Numerous methods of forming splices between coaxial cables have been proposed. One form of splice that has proved to be particularly successful is that described in U.S. Pat. No. 4,144,404, the disclosure of which is incorporated herein by reference. In this form of device a single in-line splice can be formed between a pair of coaxial cables by means of an arrangement that includes a connector for joining the central conductors of the coaxial cables, and a heat-shrinkable sleeve that contains a shield portion, for example a solder-impregnated braid. In order to form a splice, the heat-shrinkable sleeve containing the shield portion is slipped over one of the coaxial cables and then the central conductors of the cables are connected by means of the connector, for example in the form of a small heat-shrinkable sleeve or ferrule that is provided with one or more solder rings. After the central conductors have been connected, the heat-shrinkable sleeve containing the shield portion is slipped over the splice region so that each end of the shield portion overlaps part of the adjacent coaxial cable shield, and the sleeve is heated to cause it to recover about the cables and to cause the shield portion to contact each coaxial cable shield.

Although this form of coaxial cable splice has been very satisfactory in practice it suffers from a number of problems: For example it is not possible to form splices between coaxial cables, and especially so-called "branch-off" splices in which a single cable enters one end of the splice and two or more cables exit from the opposite end of the splice, that will maintain their integrity when subjected to large changes in ambient pressure as may be experienced for example in an aircraft as it repeatedly changes altitude. It is possible in certain cases for the recoverable sleeve to fracture at the end of the shield portion when the splice is subjected to a bending stress, or for the edge of the shield portion to pierce the outer heat-shrinkable tubing. In addition, it is possible for microchannels to be formed between the interior of the splice and the exterior of the splice along the coaxial cable by ejection of solder and/or flux before the heat-shrinkable sleeve has been able to cool.

SUMMARY OF THE INVENTION

According to the present invention, there is provided a method of forming a sealed electrical connection to a coaxial cable which comprises a central conductor, a cable shield separated from the central conductor by a dielectric, and a cable jacket located over the shield, which method comprises:

(a) forming an electrical connection between the central conductor of the coaxial cable and another conductor;

(b) positioning a first heat-shrinkable sleeve over the coaxial cable and the other conductor and positioning a quantity of thermoplastic sealing material over the jacket of the coaxial cable, the heat-shrinkable sleeve containing a shield portion for connecting the shield of the coaxial cable to another shielding element;

(c) heating the heat-shrinkable sleeve to form an insulated electrical connection in which the shield portion of the heat-shrinkable sleeve is electrically connected to the shield of the coaxial cable and part of the quantity of thermoplastic sealing material extends beyond the end of the recovered heat-shrinkable sleeve; and (d) positioning an outer thermoplastic element about the end of the connection so formed and recovering a further heat-shrinkable sleeve over the connection so that the thermoplastic element is enclosed within the further heat-shrinkable sleeve (when recovered) and fuses with the quantity of thermoplastic sealing material so that the thermoplastic sealing material and the thermoplastic element together form a barrier against ingress of moisture to the electrical connection.

In the broadest aspect of the invention the coaxial cable may be connected to any appropriate component for example an electrical connector in which case the other conductor may be in the form of a connector pin and the other shielding element may be the shell or housing of the connector. The method according to the invention is especially suitable for the formation of splices between coaxial cables, and so, according to a preferred aspect, the invention comprises a method of forming a splice between at least two coaxial cables each of which comprises a central conductor, a cable shield separated from the central conductor by a dielectric and a cable jacket located over the cable shield, which method comprises:

(a) forming an insulated electrical connection between the central conductors of the coaxial cables;

(b) positioning a first heat-shrinkable sleeve over the connected electrical cables and positioning a quantity of thermoplastic sealing material over the jacket of each coaxial cable, the heat-shrinkable sleeve containing a shield portion for forming a common shield between the shields of the coaxial cables;

(c) heating the heat-shrinkable sleeve to form an insulated splice in which the shield portion of the heat-shrinkable sleeve is electrically connected to the shields of the coaxial cables and part of each quantity of thermoplastic sealing material extends beyond the end of the recovered heat-shrinkable sleeve; and (d) positioning an outer thermoplastic sleeve about each end of the splice so formed and recovering a further heat-shrinkable sleeve over the splice so that the thermoplastic sleeves are enclosed within the further heat-shrinkable sleeve (when recovered) and fuse with the quantities of thermoplastic sealing material so that the thermoplastic sealing material and thermoplastic sleeves together form a barrier against ingress of moisture to the splice.

DESCRIPTION OF THE INVENTION

The method according to the invention may be used for forming a single in-line splice between a pair of coaxial cables. However the major problems arise, and the biggest advantages are gained according to the invention, when a so-called "branch-off" is formed in which a single coaxial cable is spliced to two or more coaxial cables that extend from the other end of the splice. Such forms of splice have proved very difficult to form in such a way that they will maintain their integrity when ambient pressure is varied.

In order to form a splice according to the present invention the central conductors of the coaxial cables are connected together by conventional means after the heat-shrinkable sleeves and any thermoplastic inserts have been positioned about the coaxial cables. The particular method by which the central conductors are joined together is not critical and any of a number of methods may be used. For example the central conductors may be manually soldered together or they may be crimped together. It is particularly advantageous for the central conductors to be connected by means of a connection device of the general type shown in U.S. Pat. No. 4,144,404 in which a longitudinally split metal ferrule is provided with one or more solder elements and the ferrule and solder elements are surrounded by a heat-shrinkable sleeve, so that the ends of the conductors may simply be inserted into the appropriate ends of the ferrule and the assembly be heated, for example by means of a hot-air gun, in order to form the connection.

After the central conductors have been connected the first heat-shrinkable sleeve containing the shield portion is positioned over the splice area and heated to recover the sleeve and to force the shield portion into contact with all the coaxial cable shields. However, in order to form a moisture proof splice a quantity of thermoplastic sealing material must be provided between the coaxial cables and the heat-shrinkable sleeve. This may be achieved by slipping a short sleeve of thermoplastic material over each of the coaxial cables before their central conductors have been connected. Alternatively the thermoplastic material may be in the form of a slit sleeve, in which case they may be positioned about the coaxial cables after their central conductors have been connected. In another form of device the thermoplastic material may be in the form of one or more hollow elements that are secured to the inner surface of the heat-shrinkable sleeve at each end of the sleeve. The quantity of thermoplastic material is chosen so that when the heat-shrinkable sleeve has been recovered about the coaxial cables, a portion of each thermoplastic element extends beyond the end of the recovered sleeve.

After the first heat-shrinkable sleeve has been recovered about the splice, an outer thermoplastic sleeve is positioned about each end of the splice so formed and a further heat-shrinkable sleeve is recovered over the splice. The outer thermoplastic sleeves may be provided separately from the further heat-shrinkable sleeve, either in the form of a number of separate sleeves that used to be slipped onto the cables before connection or in the form of a number of slit sleeves that can be positioned about the cables or splice at any time during the splicing operation. Normally, however, the outer thermoplastic sleeves will be located on the inner surface of the further heat-shrinkable sleeve before assembly of the splice so that they are automatically located in the correct axial position in the splice.

According to another aspect, the invention provides an arrangement for forming a splice between at least two, and preferably more than two, coaxial cables, each of which cables comprises a central conductor, a cable shield separated from the central conductor by a dielectric, and a cable jacket located over the cable shield, which arrangement comprises:

(i) a device for forming an electrical connection between the central conductors of the coaxial cables;

(ii) a first heat-shrinkable sleeve that is capable of being recovered over the connected coaxial cables, the heat-shrinkable sleeve containing a shield portion for forming a common shield between the shields of the coaxial cables;

(iii) a plurality of elements formed from a thermoplastic sealing material for forming a seal between the first heat-shrinkable sleeve and the coaxial cables;

(iv) a further heat-shrinkable sleeve capable of being positioned over, and recovered onto the splice formed by the coaxial cables and the first heat-shrinkable sleeve; and (v) a plurality of additional thermoplastic elements that are capable of being located between the coaxial cables and the further heat-shrinkable sleeve and which will melt when the further heat-shrinkable sleeve is recovered.

Any cross-linkable polymeric material to which the property of dimensional recoverability may be imparted such as those disclosed in U.K. Pat. specification No. 990,235 may be used to form the heat-shrinkable sleeves. Polymers that may be used include polyolefins such as polyethylene and ethylene copolymers for example with butene, vinyl acetate or ethyl acrylate, polyamides, polyvinyl chloride or polyvinylidine fluoride. Preferably the heat-shrinkable sleeves are transparent in order to enable the person forming the splice to observe when the solder has melted and when to stop further heating. The thermoplastic elements that are located within the heat-shrinkable sleeves may be formed from any appropriate non-crosslinked polymeric material for example from polyethylene, ethylene copolymers or from the polymer that is used to form the heat-shrinkable sleeve.

The term "solder" as used herein includes both conventional metallic solder and solder adhesives in which a hot-melt adhesive, e.g. a polyamide hot-melt adhesive, or a thermosetting adhesive such as an epoxy adhesive, is filled with metal particles, e.g. with silver flake. In most cases, however, the solder inserts will be formed from conventional metallic solder. The solder and/or heat-shrinkable sleeve may incorporate a temperature indicator to indicate when sufficient heat has been applied to the sleeve. For example the solder may incorporate a thermochromic composition as described in British Pat. specification No. 2,109,418. Alternatively or in addition two different solders having different melting points may be employed so that the melting of the higher melting point solder indicates that sufficient heat has been applied to form a satisfactory joint. For example a 63% Sn/37% Pb solder which melts at 183° C. may be used in conjunction with a 96.5% Sn/3.5% Ag solder which melts at 220° C. Devices that employ dual solder inserts are described in our copending British patent application No. 8710489. The disclosures of these two patent applications are incorporated herein by reference.

BRIEF DESCRIPTION OF THE DRAWING

One form of method and arrangement in accordance with the present invention will now be described by way of example with reference to the accompanying drawings in which.

DESCRIPTION OF PREFERRED EMBODIMENTS

Referring to the accompanying drawings a splice between three coaxial cables 1, 2 and 3 is formed by cutting back the jacket 4, braid 5 and dielectric by appropriate amounts to expose the underlying components. The various parts of the splicing assembly are then slipped over the end of the cables and the central conductors 6 of the cables are joined together. The particular method of connecting the central conductors does not form part of the invention and the connection between the central conductors has not been shown for the sake of clarity. The conductors may be connected for example by means of a crimp, although it is preferred to use a device of the type described in U.S. Pat. No. 4,144,404 with suitable modification so that one end of the device is able to receive two conductors. The device comprises a slit tube of metal that can be slipped over the ends of the central conductors and is provided on its exterior with one or more rings of solder and, surrounding the sleeve and solder, a heat-shrinkable polyvinylidine fluoride sleeve. When the device is positioned about the ends of the conductors and heated the solder melts, flows through the slit in the sleeve and forms a secure joint between the metal sleeve and each of the conductors of the cables.

Figure 1:
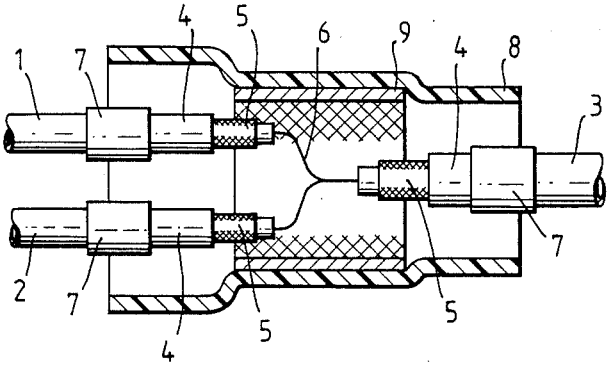
FIG. 1 is a schematic sectional side elevation through a splice between three coaxial cables during formation of the splice.

After the central conductors of the cables have been connected, thermoplastic sleeves 7 formed from noncrosslinked polyethylene, which had previously been slipped onto the coaxial cables 1 are each positioned close to the cut end of the jacket 4 of each cable, and a heat-shrinkable sleeve 8 formed from polyvinylidine fluoride which had also been slipped onto one of the cables and which includes a solder-impregnated braid 9 is slid over the assembly as shown in FIG. 1 so that the thermoplastic sleeves 7 are positioned at each end of the heat-shrinkable sleeve 8. The assembly is heated so that the heat-shrinkable sleeve 8 recovers and forces each end of the solder-impregnated braid 9 into good contact with the exposed portion of each braid 5 of the cables, and so that the solder in the braid 9 will form a permanent electrical connection between the braid 9 and the braids 5 of the cables. When the assembly is heated the thermoplastic sleeves 7 will melt and flow to form a moisture-proof seal between the cables and heat-shrinkable sleeve 8 at each end of the sleeve, and a quantity 10 of the thermoplastic material will extend beyond the ends of the sleeve 8.

Figure 2:
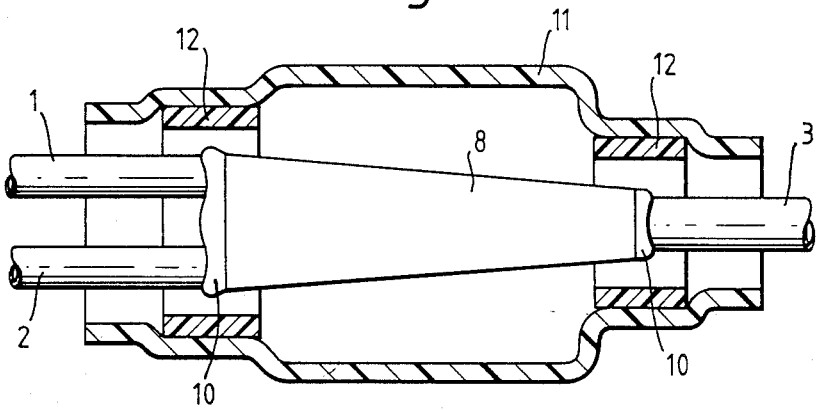
FIG. 2 is a schematic view showing the splice of FIG. 1 at a later stage in its formation.

After recovery of the heat-shrinkable sleeve 8 to form the electrical splice, a further heat-shrinkable sleeve 11 formed from polyvinylidine fluoride which had previously been slipped over one of the cables is positioned over the splice as shown in FIG. 2. The sleeve 11 is provided with two inserts 12 of thermoplastic material, e.g. uncrosslinked polyethylene, one insert located in the region of each end of the sleeve 11 and the two inserts being spaced sufficiently apart from each other that the inserts will be at the same axial position as the quantities of thermoplastic material 10 that extend from the ends of the sleeve 8. The assembly is then heated as before to cause the heat-shrinkable sleeve 11 to recover about the sleeve 8 and the coaxial cables, and to cause the inserts 12 to melt and coalesce with the quantities of thermoplastic material.

Figure 3:
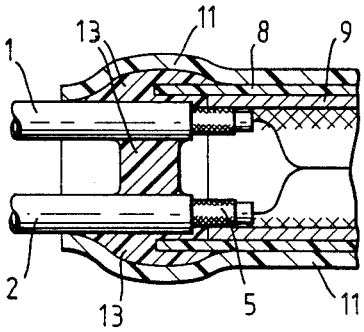
FIG. 3 is a schematic view showing the splice of FIGS. 1 and 2 after completion.

The resulting assembly is shown in FIG. 3. In this assembly the thermoplastic sleeves 7 and the thermoplastic inserts 12 have coalesced to form a single mass 13 of thermoplastic sealant at each end of the splice. This mass of sealant will maintain the moisture-proofness of the splice during cycling of the external pressure and/or during mechanical handling of the splice. During severe flexion it is possible for strands of the braid 9 to pierce the wall of the sleeve 8 in the region of the ends of the braid 9. However, by the presence of a relatively thick mass 13 of thermoplastic material on the exterior of the sleeve 8 in this region it is possible to prevent the strands of the braid 9 puncturing the sleeve 11 and so cause the splice to maintain its integrity. In addition it is possible to improve the elasticity of the splice in the region of the ends of the braid 9 and so reduce the risk of fracture of the sleeve 8 when the assembly is flexed.

I claim:

1. A method of forming a sealed electrical connection to a coaxial cable which comprises a central conductor, a cable shield separated from the central conductor by a dielectric, and a cable jacket located over the shield, which method comprises:

(a) forming an electrical connection between the central conductor of the coaxial cable and another conductor;

(b) positioning a first heat-shrinkable sleeve so that it extends over the coaxial cable and the other conductor with one end positioned around the coaxial cable, and positioning a quantity of thermoplastic sealing material over the jacket of the coaxial cable so that part of the quantity of thermoplastic sealing material extends beyond said end of the sleeve the heat-shrinkable sleeve containing a shield portion for connecting the shield of the coaxial cable to another shielding element;

(c) heating the heat-shrinkable sleeve to form an insulated electrical connection in which the shield portion of the heat-shrinkable sleeve is electrically connected to the shield of the coaxial cable and part of the quantity of thermoplastic sealing material extends beyond said end of the recovered heat-shrinkable sleeve; and (d) positioning an outer element of a thermoplastic sealing material about said end of the first sleeve and recovering a second heat-shrinkable sleeve over said first sleeve and said outer element so that said outer element is enclosed within the second heat-shrinkable sleeve and fuses with the thermoplastic sealing material so that the thermoplastic sealing material and the thermoplastic element together form a barrier against ingress of moisture to the electrical connection

2. A method of forming a splice between at least two coaxial cables each of which comprises a central conductor, a cable shield separated from the central conductor by a dielectric and a cable jacket located over the cable shield, which method comprises:

(a) forming an insulating electrical connection between the central conductors of the coaxial cables;

(b) positioning a first heat-shrinkable sleeve over the connected electrical cables and positioning a quantity of thermoplastic sealing material over the jacket of each coaxial cable so that quantities of thermoplastic sealing material extend beyond respective ends of said first sleeve the heat-shrinkable sleeve containing a shield portion for forming a common shield between the shields of the coaxial cables;

(c) heating the heat-shrinkable sleeve to form an insulated splice in which the shield portion of the heat-shrinkable sleeve is electrically connected to the shields of the coaxial cables and part of each quantity of thermoplastic sealing material extends beyond the respective end of the recovered heat-shrinkable sleeve; and (d) positioning an outer element of a thermoplastic material about end of the first sleeve and recovering a second heat-shrinkable sleeve over said first sleeve and said outer elements so that said outer elements are enclosed within the second heat-shrinkable sleeve and fuse with quantities of thermoplastic sealing material so that the thermoplastic sealing material and thermoplastic elements together form a barrier against ingress of moisture to the splice.

3. A method as claimed in claim 2, wherein a branch-off is formed in which one coaxial cable is spliced to at least a pair of coaxial cables that extend from one end of the splice.

4. A method as claimed in claim 1, wherein the or each quantity of thermoplastic sealing material is in the form of a sleeve or split sleeve that can be positioned over the end of the appropriate coaxial cable.

5. A method as claimed in claim 1, wherein the or each quantity of thermoplastic sealing material is provided separately from the said first heat-shrinkable sleeve.

6. A method as claimed in claim 5, wherein the or each quantity of thermoplastic sealing material is in the form of a sleeve and is positioned on the or each coaxial cable before the electrical connection between the central conductors of the coaxial cables is formed.

7. A method as claimed in claim 2, wherein the central conductors of the coaxial cables are soldered together.

8. A method as claimed in claim 7, wherein the central conductors of the coaxial cables are connected together by means of a heat-shrinkable sleeve that contains a quantity of solder.

9. A method as claimed in claim 1, wherein the shield portion is mechanically deformable.

10. A method as claimed in claim 9, wherein the shield portion is formed from a braid.

11. A method as claimed in claim 9, wherein the deformable shield portion contains a quantity of solder.

12. A method as claimed in claim 1, wherein each outer thermoplastic element is located inside the second heat-shrinkable sleeve.

* * * * *